US005361844A

United States Patent [19]

Taylor et al.

[11] Patent Number: 5,361,844

[45] Date of Patent: Nov. 8, 1994

[54] WELL FISHING GRAPPLE ASSEMBLY AND METHOD ABSTRACT

[75] Inventors: Robert B. Taylor, College Station; Ken A. Penske; Clif E. Cook, both of Houston, all of Tex.

[73] Assignee: Gotco International, Inc., Houston, Tex.

[21] Appl. No.: 77,783

[22] Filed: Jun. 15, 1993

[51] Int. Cl.[5] ..... E21B 31/00

[52] U.S. Cl. ..... 166/301; 166/98

[58] Field of Search ..... 166/301, 98, 178; 294/86.24, 86.12, 86.34

[56] References Cited

U.S. PATENT DOCUMENTS

| | | | |
|---|---|---|---|
| 1,785,590 | 12/1930 | Miller . | |
| 2,745,693 | 5/1956 | McGill | 294/102 |
| 2,893,491 | 7/1959 | Crowe | 166/103 |
| 3,108,637 | 10/1963 | Lee et al. | 166/99 |
| 3,380,528 | 4/1968 | Timmons | 166/14 |
| 3,638,988 | 2/1972 | Brown | 294/86.18 |
| 4,061,389 | 12/1977 | Keller et al. | 294/86.3 |
| 4,093,294 | 6/1978 | Taylor | 294/86.25 |
| 4,232,894 | 11/1980 | Taylor | 294/86.21 |
| 4,284,137 | 8/1981 | Taylor | 166/137 |
| 4,877,085 | 10/1989 | Pullig, Jr. | 166/98 |
| 5,022,473 | 6/1991 | Taylor | 175/299 |
| 5,074,361 | 12/1991 | Brisco et al. | 166/98 X |

*Primary Examiner*—Thuy M. Bui

*Attorney, Agent, or Firm*—Matthews & Associates

[57] ABSTRACT

An apparatus and method for removing fish from a well, said apparatus including a top sub with upper and lower ends, the upper end adapted to be connected to a drill string, a grapple sleeve connected to the lower end of the top sub and a grapple, which in the preferred embodiment incorporates grapple fingers so as to externally engage and grasp a fish in a well slidably mounted within the grapple sleeve. The grapple is mounted to the top sub and extends out of and into the grapple sleeve such that once the fish is engaged the grapple may be withdrawn into the grapple sleeve, which in turn allows for the maintaining of a constant force on the grapple and fish engaged therein. The method of the present invention includes running into the well a drill string having a grappling tool attached thereto, locating the fish by making contact with the grappling tool, engaging the fish with the grapple, and removing the fish from the well.

9 Claims, 5 Drawing Sheets

WELL FISHING GRAPPLE ASSEMBLY AND METHOD ABSTRACT

BACKGROUND OF THE INVENTION

1. Field of the Invention

This invention generally relates to retrieval of down-hole in-place or loose apparatus on materials used in the operations of oil and gas wells. More specifically, the invention pertains to an assembly and method which offers the capability for retrieval of fish, such as electric submersible pumps, or the like, for maintenance, re-building, and later re-use. Fish is a term commonly used in the oil and gas industry for loose and in-place down-hole items, such as tools, devices or other items which are to be removed from the well.

Though a number of prior art fishing tools can be located, the present invention is designed so as to remove fish from a cased hole where there exists too little clearance between the outer diameter (OD) of the fish and the inner diameter (ID) of the oil well casing. Consequently, there has existed a long-felt unresolved need for a device which will retrieve fish where limited clearance in the oil well casing is a necessary consideration. It is also necessary for the tool to retrieve the fish by an external catch eliminating or minimizing any damage to the fish while still having enough strength and power to pull the fish from the well.

The principal disadvantage of other inventions employed for removing fish from down-hole locations, such as spear-type devices, is that the fish cannot be re-used after removal from the well. In addition, the prior art includes devices which are not capable of functioning where there is limited clearance between the well casing and the fish. Furthermore, some of the devices, including conventional overshots or other external catch retrieval devices, can not lift and remove heavier, difficult to grasp items, such as electric submersible pumps without damage.

2. Related Art

The presently known prior art includes the following: Miller U.S. Pat. No. 1,785,590, McGill U.S. Pat. No. 2,745,693, Crowe U.S. Pat. No. 2,893,491, Lee U.S. Pat. No. 3,108,637, Timmons U.S. Pat. No. 3,380,528, Brown U.S. Pat. No. 3,638,988, Keller U.S. Pat. No. 4,061,389, Taylor U.S. Pat. No. 4,093,294, Taylor U.S. Pat. No. 4,232,894, Taylor U.S. Pat. No. 4,284,137, and Taylor Pat. No. 5,022,473.

OBJECTS OF THE INVENTION

An object of the present invention is to provide an assembly which can be employed for the retrieval of fish which produces minimal or no damage to the fish.

Another object of the invention is to provide an assembly which can be employed for the retrieval of fish which utilizes an expandable sleeved grapple.

Another object of the invention is to provide an assembly which can be employed for the retrieval of fish which have an outside diameter nearly the same dimension as the inside diameter of the well casing.

SUMMARY OF THE INVENTION

The foregoing and other objects and advantages of the invention are provided in an assembly and method for use in a well fishing and retrieval operating string which provides expandable capability for retrieval of fish, including down-hole in-place tools or other items, such as electric submersible pumps. The assembly includes a top sub, a sleeve with integral keys, a grapple element having upper and lower notches or J-latches which are located on opposite ends of connecting slots, and grapple fingers. When the assembly is run down the well, the grapple element is extended and held in the extended position by having the keys positioned in contact with the upper J-latches of the grapple element. The assembly is adapted to allow expansion of the grapple fingers around the fish by the application of weight to the operating string until the fish is fully engaged. When the assembly is to be removed from the well, the keys are released from contact with the upper J-latches by rotating the string ⅛th turn, thereby allowing the keys to slide down the correcting slots and the sleeve to slide down and completely enclose the grapple. While weight is continuously applied to the string, the assembly is rotated ⅛th turn in the opposite direction, engaging the keys with the lower J-latches, and the assembly is prepared for lifting the fish from the well.

DESCRIPTION OF THE PREFERRED EMBODIMENT

Figure 1:
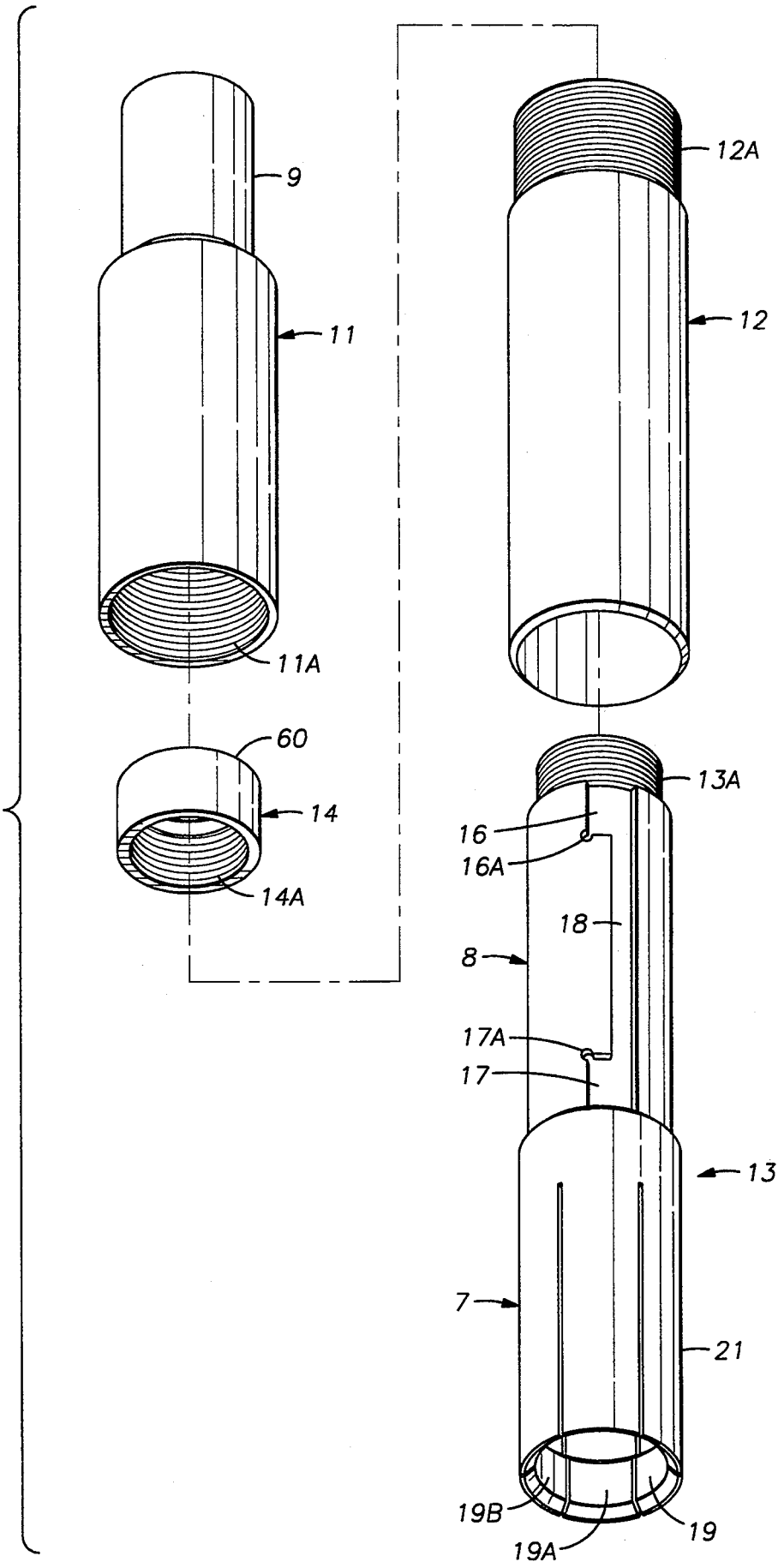
FIG. 1 shows an exploded isometric of the well fishing grapple.

FIG. 1 shows an exploded isometric of the preferred embodiment of the well fishing grapple, 10, that consists of four component parts which are a top sub, 11, a sleeve, 12, a grapple element, 13, and a grapple retainer, 14. Top sub, 11, threadedly engages with sleeve, 12, by virtue of internal threads, 11*a*, on top sub, 11, and external threads, 12*a*, of sleeve, 12. The grapple retainer, 14, threadedly engages grapple, 13, by virtue of internal threads, 14*a*, and external threads, 13*a*.

Figure 2:
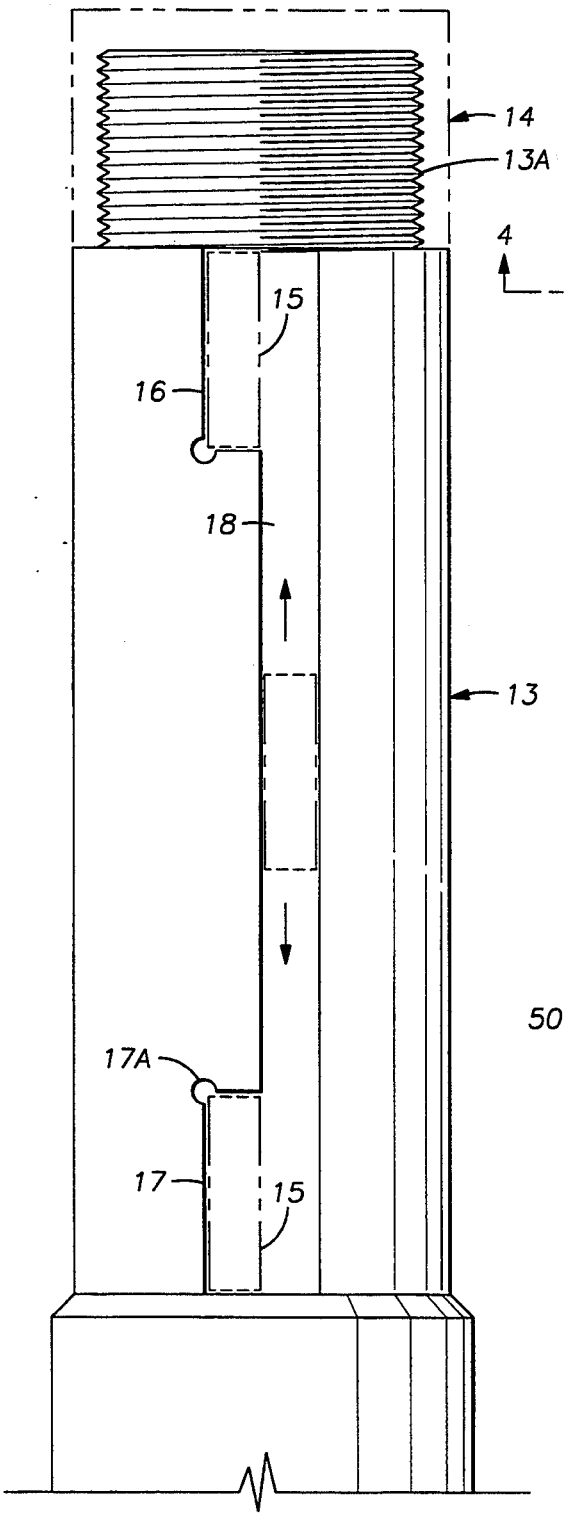
FIG. 2 shows a cross-section view of the well fishing grapple.

The grapple element, 13, is shown in an elevation view in FIG. 2. As indicated in FIG. 2, keys, 15, located inside the sleeve, 12, (not shown in FIG. 2) and spaced 120 degrees circumferentially apart, are shown (in phantom lines) in contact, or close proximity, to the corresponding notches or J-latches, 16, located at the upper and lower portion or neck of the grapple element, 13. As shown in FIG. 2, the keys, 15, slide up and down through slots, 18, also indicated in FIG. 2. When the fishing grapple, 10, is lowered into the well casing, the keys, 15, are in direct contact with the upper J-latches, 16. When the fishing grapple, 10, is removed from the well casing, the keys, 15, are in direct contact with the lower J-latches, 17.

The upper J-latches, 16, will ensure the grapple element, 13, will remain extended when the fishing grapple, 10, is lowered into the well casing, 50. The lower J-latches, 17, ensure the grapple element, 13, will remain inside the sleeve, 12, when it is removed from the well casing, 50. The well fishing grapple, 10, is assembled as indicated in FIG. 1; details of assembly will be described hereinafter.

As indicated in FIG. 1, the top sub, 11, has internal threads, 11*a*, at the lower portion; the sleeve, 12, has outside threads, 12*a*, at the upper portion; the grapple element, 13, has outside threads, 13*a*, at the upper portion; and the grapple retainer, 14, has internal threads, 14*a*, and is open at both ends, 60. Although it is not shown in FIG. 1, the top sub, 11, has internal threads at the upper portion for connection to the fishing string. (See FIG. 4)

Referring again to FIG. 1, the grapple element, 13, has an inwardly projecting grip, 19, which has sloped surfaces at the upper and lower portion of the grip, 19*a* and *b*, and a flat surface in the middle portion, 19*c*; the grip, 19, is located at the lower portion and inside the grapple element, 13. The grapple element, 13, incorporates at the upper end an external threaded service, 13*a*, as discussed above, which corresponds to internal threaded service, 14*a*, of the grapple retainer 14. The latch section, 8, incorporates a plurality, in this case 3, of latch slots, 18, which correspond to sleeve keys, 15, not shown. Each slot has an upper J-latch notch, 16, and lower J-latch notch, 17. The lower grapple section, 7, of grapple element, 13, utilizes a plurality of grapple fingers, 21, which are separated by a plurality of longitudinal slits, 21*a*.

Figure 10:
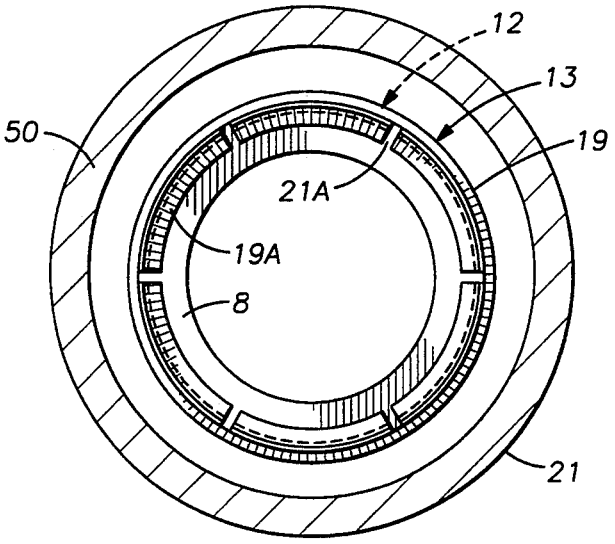
FIG. 10 shows a cross-section view of the grapple viewed as indicated through FIG. 3.
Figure 3:
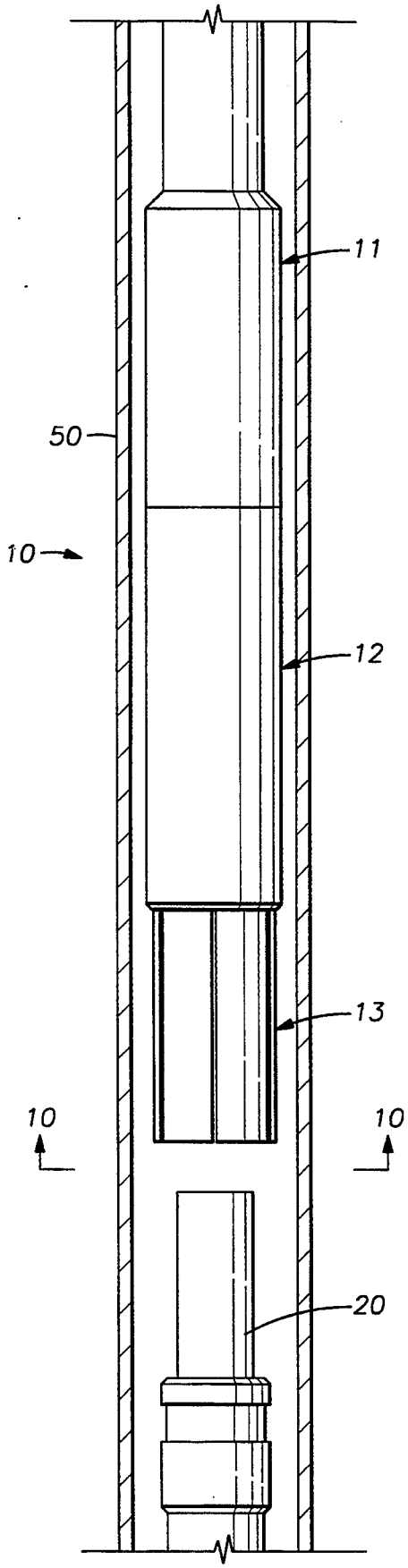
FIG. 3 shows an elevation view of the grapple as it would appear inside a well casing.

FIG. 3 shows an elevation view of the grapple tool, 10, as it would appear inside a well casing, 50. The grapple tool, 10, is shown approaching the fish, as for example a submersible pump, 20, of the type shown. As indicated in FIG. 3, a cross-section view of the grapple tool, 10, is shown in FIG. 10 as it would appear looking upward from the location of the fish, 20, before the grapple fingers, 21, make contact with the fish, 20.

Figure 9:
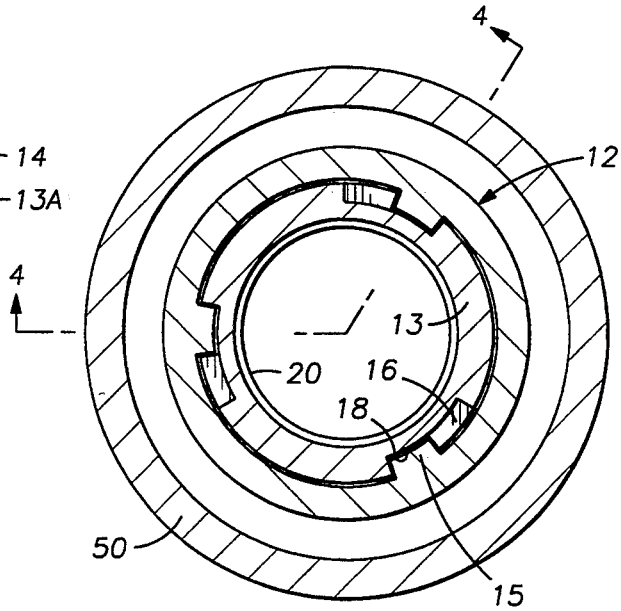
FIG. 9 shows a cross-section view of the grapple viewed as indicated through FIG. 4.
Figure 4:
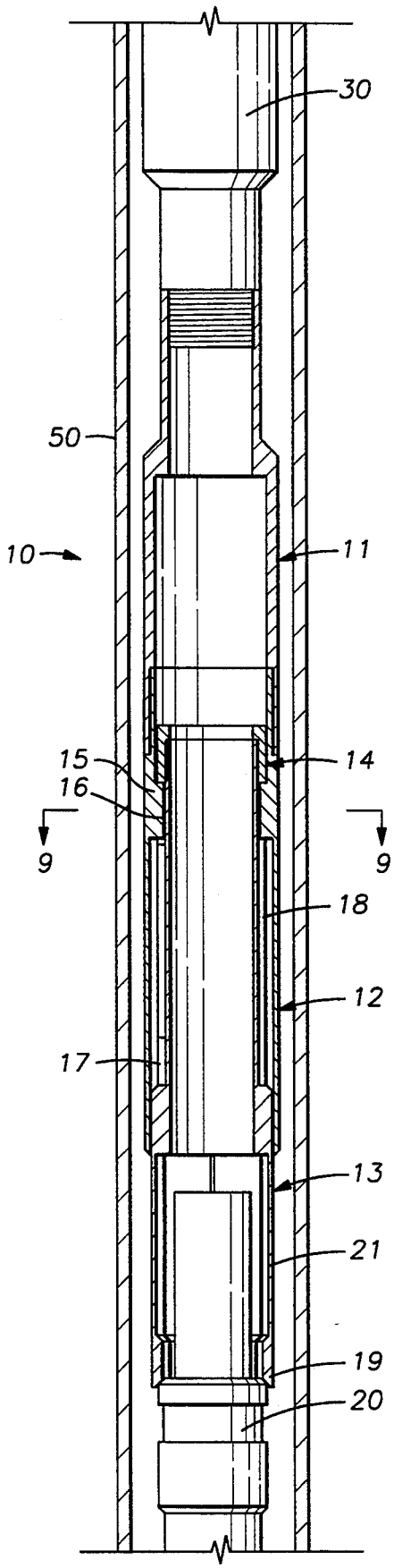
FIG. 4 shows a cross-section view of the grapple after it makes initial contact with the fish.

FIG. 4 shows a cross-section view of the grapple, 10, after it makes initial contact with the fish, 20. Expansion of the lower portion, or fingers, 21, of the grapple element, 13, around the fish, 20, resulting from external application of weight to the well string, 30, is shown in the initial stage of expansion. As indicated in FIG. 4, a cross-section view of the well fishing grapple, 10, is shown in FIG. 9 as it would appear at that point, after the grapple makes contact with the fish, 20.

Figure 5:
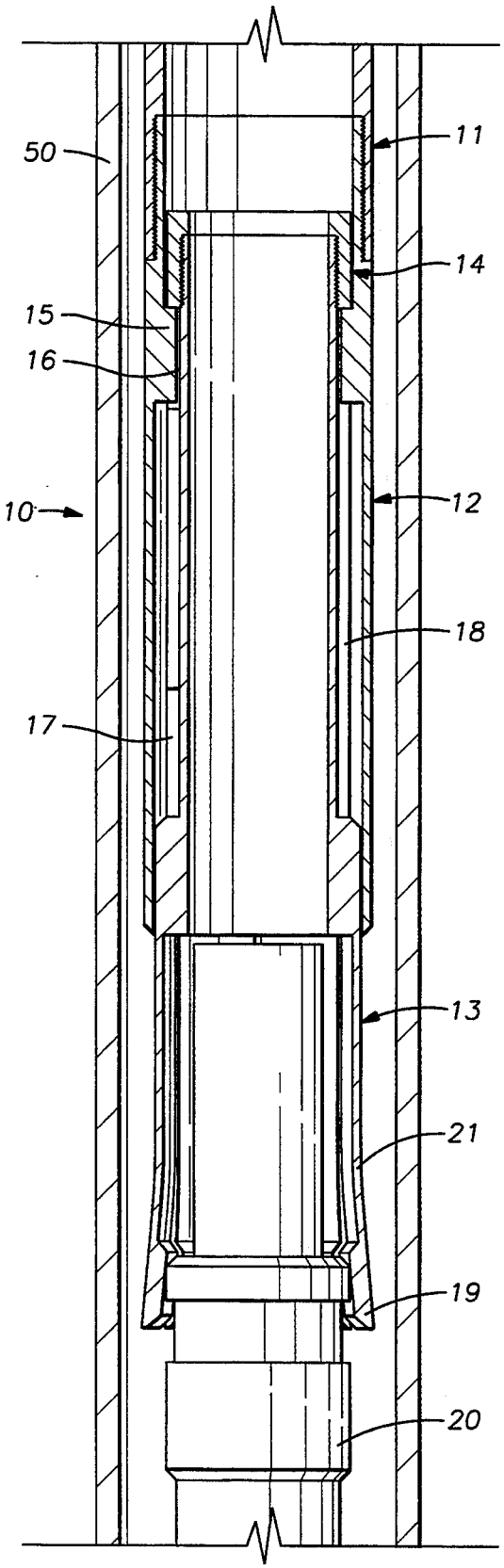
FIG. 5 shows a cross-section view of the grapple with the fingers fully expanded around the fish.

Weight is continuously applied externally to the well string, transmitted through the top sub, 11, then to the sleeve, 12, on to the keys, 15, in contact with the upper J-latches, 16, then through the grapple element, 13, which forces the fingers, 21, with the grip, 19, to expand around the fish, 20. FIG. 5 shows a cross-section view of the grapple, 10, with the fingers, 21, fully expanded around the fish, 20.

Figure 6:
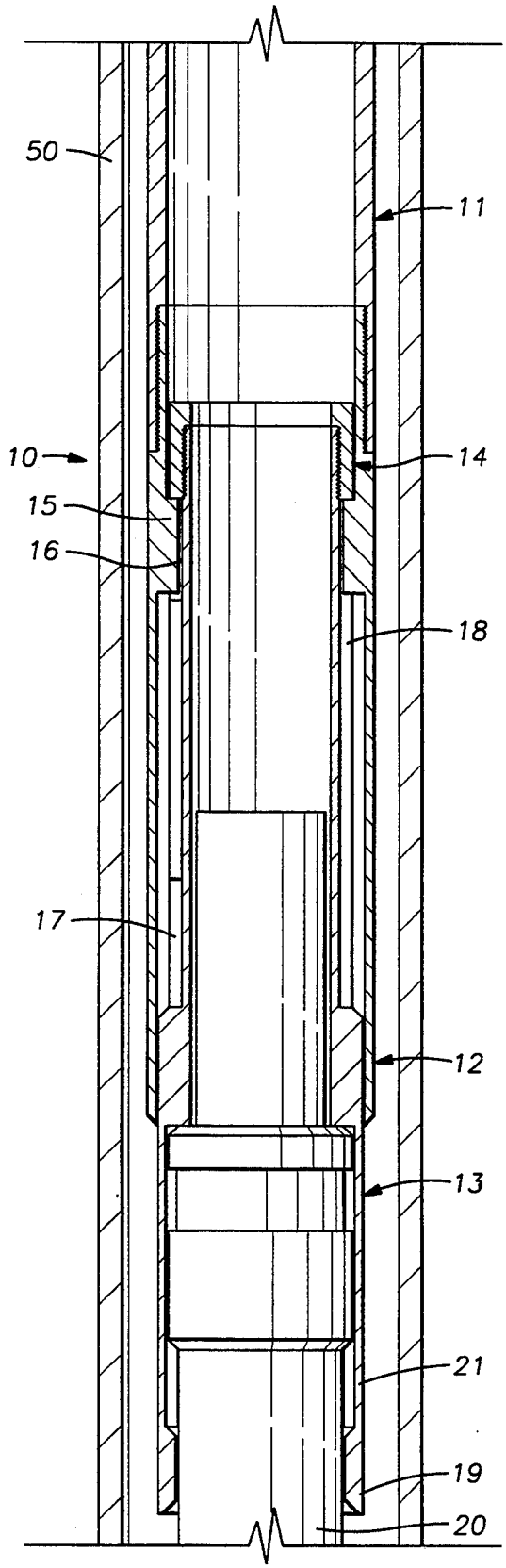
FIG. 6 shows a cross-section view of the grapple after the fish has been fully engaged by the grapple.

FIG. 6 shows a cross-section view of the grapple, 10, after the fish, 20, has been fully engaged by the grapple, 10, resulting from the continuous application of weight to the well string.

Figure 7:
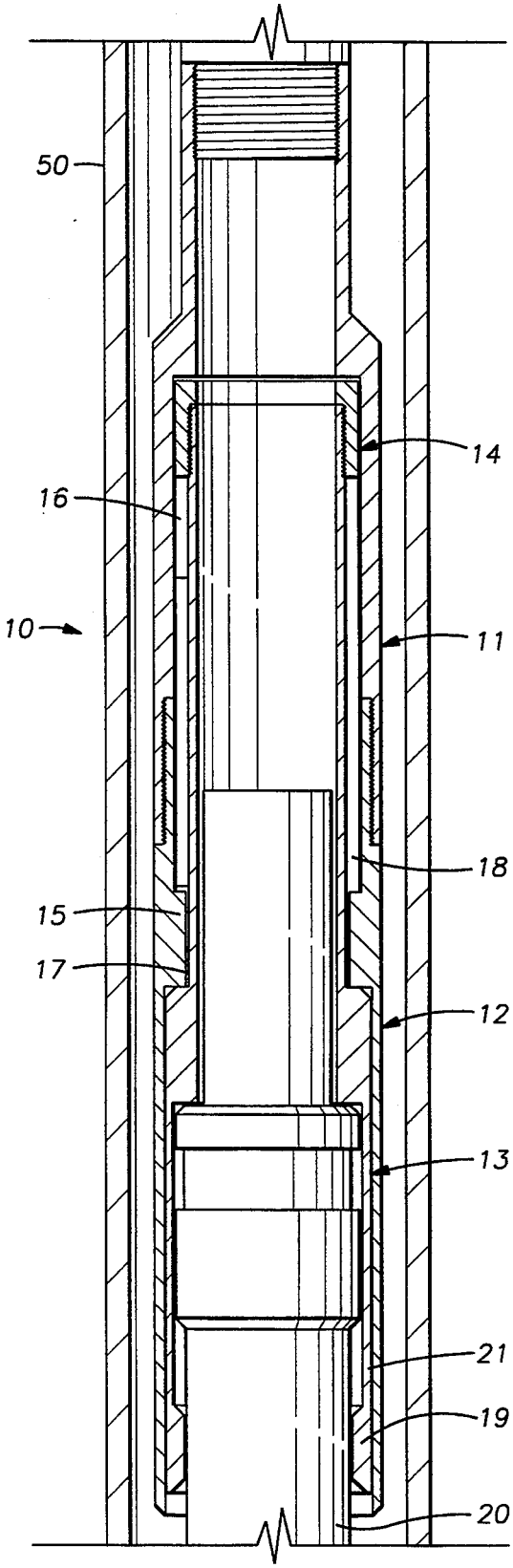
FIG. 7 shows a cross-section view of the grapple with the keys in direct contact with the lower J-latch.
Figure 8:
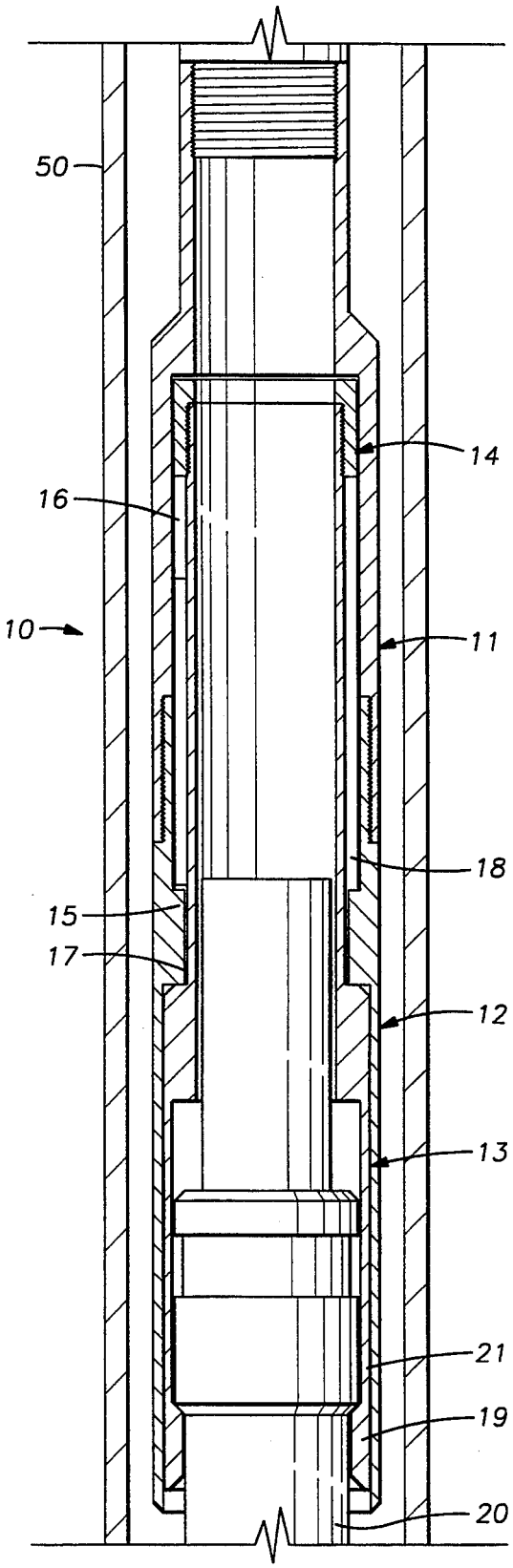
FIG. 8 shows a cross-section view of the grapple being removed from the well with the fish.

FIG. 7 shows a cross-section view of the grapple, 10, with the keys, 15, in direct contact with the lower J-latches, 17. This configuration is maintained while the grapple, 10, and the fish, 20, are pulled out of the well casing, 50, as shown in FIG. 8.

It is to be understood that the form of the invention herein shown and described is to be taken as a preferred example, and that numerous variations will be obvious to those skilled in the art in the light of the teachings of this specification, without departing from the scope of the hereinafter claimed subject matter.

OPERATION OF THE PREFERRED EMBODIMENT

Assembly of the fishing grapple, 10, as indicated in FIG. 1, is as follows. The grapple element, 13, is stood upright on a flat surface (with the threaded portion up). The sleeve, 12, is slid over the grapple element, 13, such that the sleeve's integral keys, 15, are positioned into the slots on the upper portion of the grapple element, 13, allowing the sleeve, 12, to slide all the way down. The threads on the upper portion of the grapple element, 13, are thereby exposed above the top of the sleeve, 12, permitting the grapple retainer, 14, to be screwed on to the grapple element, 13. The top sub, 11, is placed over the grapple element, 13, and retainer, 14, until it engages the threads on the upper portion of the sleeve, 12; the top sub, 11, is screwed on to the grapple element, 13, until it is hand tight. Further tightening, as required, may be accomplished by placing the assembled fishing grapple, 10, in a vise, clamping on the upper portion or neck of the top sub, 11. For tightening with a wrench, the wrench should be placed on the sleeve, 12, at the point where the material is thickest, on the sleeve, 12, on the section immediately below the thread. Because the sleeve, 12, generally has a thin wall, care must be exercised in tightening such that the sleeve, 12, will not be distorted. After tightening, the fishing grapple, 10, is prepared for use by extending the grapple element, 13, and engaging the keys, 15, into the upper J-latches, 16.

Referring now to FIG. 3, the fishing grapple, 10, is shown as it would appear while descending the well casing, 50. Keys, 15, as shown in FIG. 4, located in the sleeve, 12, are engaged by being in direct contact with the upper J-latches, 16, which are an integral part of the grapple element, 13. A screw-on grapple retainer, 14, is employed as a means for retaining the grapple element, 13, within the sleeve, 12. A top sub, 11, is screwed on to the sleeve, 12. The entire assembly, 10, is screwed on to a fishing string for the trip down the well casing, 50.

When the assembly reaches the fish, 20, weight is applied to the fishing string causing the lower portion, or fingers, 21, of the grapple element, 13, to expand around the fish, 20, as illustrated in the cross-section view of FIG. 5. The weight applied to the fishing string is transmitted through the top sub, 11, screwed-on to the sleeve, 12, forcing the keys, 15, against the upper J-latches, 16, which, being an integral part of the grapple element, 13, causes the fingers, 21, of the grapple element, 13, to come in direct contact with the fish, 20, and thereby begin expanding.

After the grapple, 10, is fully engaged to the fish, 20, as shown in FIG. 6, the fishing string is rotated (counter-clockwise looking down the string) $\frac{1}{8}$th turn. This disengages the keys, 15, located in the sleeve, 12, from the upper notches or J-latches, 16. The weight is continuously applied to the fishing string, and the keys, 15, slide down to the bottom of the vertical slot, 18, in the grapple element, 13, at which point the fishing string is rotated in the opposite direction (clockwise) $\frac{1}{8}$th turn. This engages the keys, 15, located in the sleeve, 12, to the lower notches or J-latches, 17. At this point the entire assembly, 10, including the fish, 20, is prepared for lifting out of the well casing, 50, as shown in FIGS. 7–8.

During the ascent, a small amount of torque (clockwise) is applied to the fishing string to assure constant contact of the keys, 15, with the lower notches or J-latches, 17.

In the event the fish cannot be retrieved, the assembly can be disengaged by rotating the fishing string (counter-clockwise) ⅛th turn, disengaging the keys, 15, located in the sleeve, 12, from the lower notches or J-latches, 17. The fishing string is lifted, which allows the keys, 15, located in the sleeve, 12, to slide up to the top of the vertical slot, 18, in the grapple element, 13, at which point the fishing string continues being pulled up, allowing the fingers, 21, of the grapple element, 13, to be expanded and pulled free from contact with the fish which cannot be retrieved. The entire assembly, minus the fish which cannot be retrieved, is then removed from the well casing, 50.

We claim:

1. An apparatus for removing a fish from a well comprising:

a. a top sub with upper and lower ends, said upper end adapted to be connected to a drill string;

b. a grapple sleeve with an upper and lower portion, said upper portion being adapted to be connected to said lower end of said top sub; and c. a grapple means adapted to externally engage and grasp a fish in a well, said grapple means being slightably mounted within said grapple sleeve.

2. The invention of claim 1 further comprising:

a. a grapple means with an upper end adapted to be threadably engaged by a grapple retainer; and b. a grapple retainer adapted to engage the said upper end of said grapple means so as to restrict the sliding movement of the grapple within said grapple sleeve.

3. The invention of claim 1 wherein:

a. said grapple means contains a lower end, said lower end being defined as less than one-half the length of said grapple; and b. said lower end of said grapple means contains a plurality of longitudinally extending fingers.

4. The invention of claim 3 wherein said longitudinally extending fingers incorporate inwardly raised surfaces.

5. The invention of claim 4 wherein said inwardly raised portions of said grapple means have upper and lower sloped shoulders.

6. The invention of claim 1 further comprising;

a. a grapple sleeve with one or more inwardly extending keys; and b. a grapple means with one or more vertically extending slots corresponding to said grapple sleeve keys, said slots containing upper and lower offset areas at the upper-most and lower-most position of said slots.

7. An apparatus for removing a fish from a well comprising:

a. a cylindrical top sub with upper and lower portions, said upper portion being narrowed and adapted to be threadedly engaged with a drill string;

b. a grapple sleeve with upper and lower portions, said upper portion being adapted to be threadedly engaged with said lower portion of said top sub and containing one or more internally extending keys; and c. a grapple means for externally engaging and grasping a fish from a well, said grapple means containing one or more vertically extending slots designed to accommodate said keys, said slots containing J-latch portions at the upper-most and lower-most extensions thereof, both of said J-latch portions being off-set in the same direction, said slots being totally contained within said grapple means.

8. The invention of claim 7 further comprising J-latch portions which will accommodate said keys with a one-eighth turn of said grapple sleeve.

9. The invention of claim 8 wherein said grapple sleeve and said top sub are of the same maximum diameter, that diameter being no greater than the internal diameter of the well within which the invention is intended to operate.

* * * * *